United States Patent [19]

Prewer

[11] 4,028,855

[45] June 14, 1977

[54] PARTITION WALL JOINTS

[75] Inventor: John R. Prewer, London, England

[73] Assignee: Pallisade Domain Limited, London, England

[22] Filed: Dec. 22, 1975

[21] Appl. No.: 643,137

[30] Foreign Application Priority Data

Dec. 24, 1974 United Kingdom ..... 55670/74

[52] U.S. Cl. ..... 52/272; 52/284; 52/36; 52/238; 52/582; 52/DIG. 13

[51] Int. Cl.[2] ..... E04B 1/38

[58] Field of Search ..... 52/36, 238, 241, 272, 52/511, 578, 582, 758 C, 758 D, 97, 122, 126, 284, 745, DIG. 13; 24/204, DIG. 18; 49/483; 160/135; 428/62; 264/182

[56] References Cited

UNITED STATES PATENTS

| | | | |
|---|---|---|---|
| 2,282,871 | 5/1942 | Malbon | 24/DIG. 18 |
| 3,127,259 | 3/1964 | Boylan | 55/511 |
| 3,292,321 | 12/1966 | Vander Schans | 52/122 |
| 3,608,258 | 9/1971 | Spratt | 52/241 |
| 3,681,882 | 8/1972 | Bettinger | 52/126 |
| 3,777,435 | 12/1973 | Perina | 52/511 |
| 3,852,926 | 12/1974 | Papsco | 52/241 |
| 3,855,382 | 12/1974 | Takeya | 264/182 |
| 3,900,652 | 8/1975 | Uraya | 428/92 |

FOREIGN PATENTS OR APPLICATIONS

| | | | |
|---|---|---|---|
| 7,300,610 | 1/1973 | Sweden | 52/DIG. 13 |
| 533,525 | 2/1941 | United Kingdom | 49/483 |

*Primary Examiner*—Price C. Faw, Jr.
*Assistant Examiner*—Henry Raduazo
*Attorney, Agent, or Firm*—Hopgood, Calimafde, Kalil, Blaustein & Lieberman

[57] ABSTRACT

A joint for use in a partition wall building assembly and method in which abutting edge surfaces forming the joint are provided with rigid self supporting fibres projecting substantially normally from the surfaces and intermeshed to resist shear movement between the surfaces. The top and bottom surfaces of a partition wall panel are provided with the projecting fibres which intermesh with fibres on the ceiling and floor surfaces to hold the panel in position. The ceiling and floor surfaces are relatively movable vertically to clamp the panel and ensure complete intermeshing of the fibres. The length and density of the fibres is such that shear movement is substantially prevented.

4 Claims, 8 Drawing Figures

Fig. 4
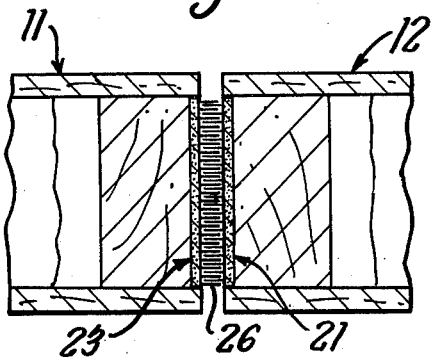
Fig. 5
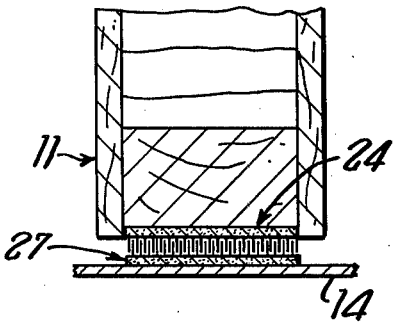
Fig. 6
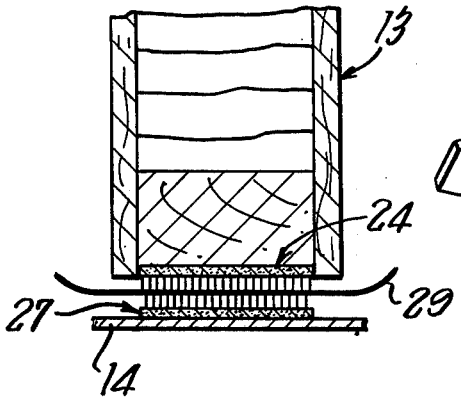
Fig. 7
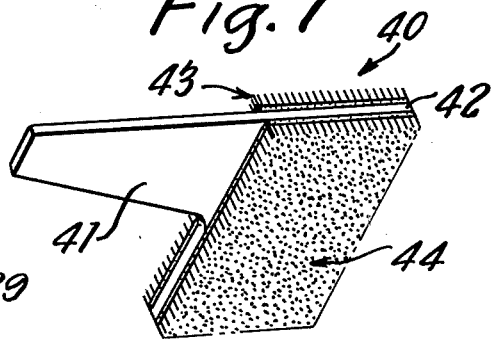
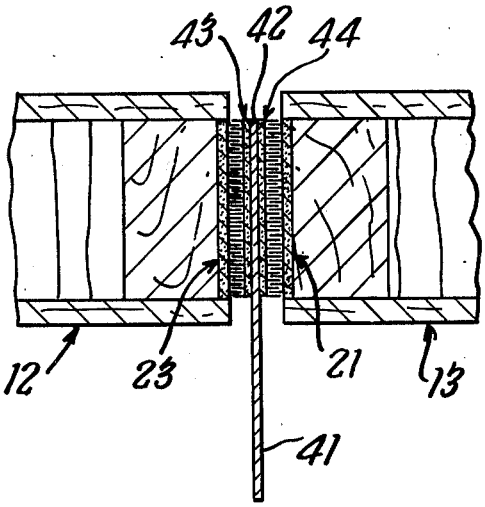
Fig. 8

PARTITION WALL JOINTS

BACKGROUND TO THE INVENTION

The present invention relates to a method of jointing two members together which is particularly suitable for use in forming the joint between the peripheral edge surface of an internal partition wall and the supporting wall, ceiling and floor surfaces of a building, or between external cladding panels.

There is a need in the building industry for an economic means and method for forming a joint between the peripheral edge surface of a wall panel and the supporting surfaces which it abuts which is secure, waterproof, flameproof and draught-proof and which enables the partition wall to be readily dismounted and reused.

It is well known in the material fastener art to attach two pieces of flexible material together by providing on one piece of material a plurality of projecting fibres with hooked ends and, on the other piece of material a plurality of fibre loops. When the two pieces of material are brought together the hooked fibres are intermeshed with the hook onto the looped fibres so as to fasten the two pieces of material together. The hooked fibres are sufficiently stiff to provide a secure attachment, but sufficiently flexible to allow the two pieces of material to be peeled apart, when required. This type of material fastener is known as VELCRO and is fully described in many patent specifications, a typical example being British Patent Specification No. 1,326,098.

This type of material fastener has a number of disadvantages. It is expensive to manufacture because the fibres on one piece of material must be formed with hooked ends and the fibres of the other piece of material must be looped. The stiffness of the fibres is critical to the proper functioning of the fastening. The material is designed to be peeled apart and the density of the fibres is relatively low for this reason. The fastening is only effective if one piece of material has the hooked fibres and the other the looped fibres. It is therefore necessary to stock both pieces of material and if two members to be fastened are inadvertently provided with hooked fibres or with looped fibres the fastening will be ineffective.

It is also known in the building art from British Patent Specification No. 1,368,260 to fasten a partition wall panel in position by providing a channel in the ceiling surface of a building, providing a resilient gasket on the floor surface and a plurality of studs which project downwardly from the hollow edge surface of the panel. The panel is then located with its upper edge in the channel and its bottom edge on the resilient gasket. The studs extend into or through any pile, carpeting material which may be laid over the gasket and indent the gasket. The engagement of the studs with the carpeting and with the resilient gasket serve to locate the bottom of the panel in position and resist any lateral force applied to the bottom of the panel.

This prior structure has the disadvantages that the resilient gasket is complex and expensive to manufacture, the formation of a channel in the ceiling is uneconomic and often impossible for design reasons and the joint achieved at the bottom edge of the panel is not complete secure. The assembly operation which involves tilting the panel to locate it in the channel is also difficult, particularly if the panel is heavy.

It is an object of the present invention to provide a joint and jointing method which will meet the requirements set out above, but which also avoids all of the disadvantages inherent in the prior art structures and methods.

STATEMENT OF THE INVENTION

According to one aspect of the present invention I provide a joint comprising first and second members having respectively first and second abutting surfaces, a plurality of substantially rigid, self supporting fibres projecting substantially normally from the first surface and a plurality of substantially rigid, self supporting fibres projecting substantially normally from the second surface, wherein the fibres on the first and second surfaces are intermeshed and the length and density of the fibres on the first and the second surfaces are such that shear movement between the first and second surfaces is substantially prevented.

According to a further aspect of the present invention I also provide a building assembly comprising at least one partition wall panel mounted between a floor surface and a ceiling surface, the said panel having a top edge surface in abutting relationship with the ceiling surface and a bottom edge surface in abutting relationship with the floor surface, a first plurality of substantially rigid, self supporting fibres projecting substantially normally from the top edge surface, a second plurality of substantially rigid self supporting fibres projecting substantially normally from the bottom edge surface, a first band of substantially rigid, self supporting fibres projecting substantially normally from the ceiling surface, a second band of substantially rigid, self supporting fibres projecting substantially normally from the floor surface, the first plurality of fibres being intermeshed with the first band of fibres and the second plurality of fibres being intermeshed with the second band of fibres, the length, rigidity and density of the fibres being such that shear movement between the top edge surface of the panel and the ceiling surface and shear movement between the bottom edge surface of the panel and the floor surface is substantially prevented.

I also provide a method of erecting a partition wall in a building comprising the steps of providing a plurality of substantially rigid, self supporting fibres on the top and bottom horizontal edge surfaces of the panel so that the fibres project from the edge surface substantially normally thereto, providing a plurality of substantially rigid self supporting fibres in a lower band along the floor surface of the building and in an upper band along the ceiling surface of the building so that the said fibres on the floor and ceiling surfaces project substantially normally thereto, aligning the panel between the upper and lower bands of fibres, moving the floor and ceiling surfaces relative to one another so as to clamp the panel between the floor and ceiling surfaces and cause the fibres on the top edge surface of the panel to intermesh with the fibres on the ceiling surface and the fibres on the bottom edge surface of the panel to intermesh with the fibres on the floor surface whereby shear movement between the top and bottom edge surfaces of the panel and the ceiling and floor surfaces respectively is substantially prevented.

Preferably the density of the fibres attached to the first and second surfaces is within the range of 30,000 to 70,000 fibres per square inch, and the average fibre length is within the range 0.06 to 0.10 of an inch.

The preferred material for the fibres is nylon but any acrylic synthetic plastics material can be used with satisfactory results. If high flame resistance is required some or all of the fibres can be made from a highly flame resistant material such as fibreglass.

DESCRIPTION OF THE DRAWINGS

FIG. 4 is a section taken on the line IV–IV of FIG. 1;

FIG. 5 is a section taken on the line V–V of FIG. 1;

FIG. 6 is a section taken on the line VI–VI of FIG. 1;

FIG. 7 is a perspective view of a bracket for use with the partition wall of FIG. 1; and FIG. 8 is a section similar to FIG. 4 but showing the bracket of FIG. 7 mounted on the partition wall.

DESCRIPTION OF THE PREFERRED EMBODIMENT

Figure 1:
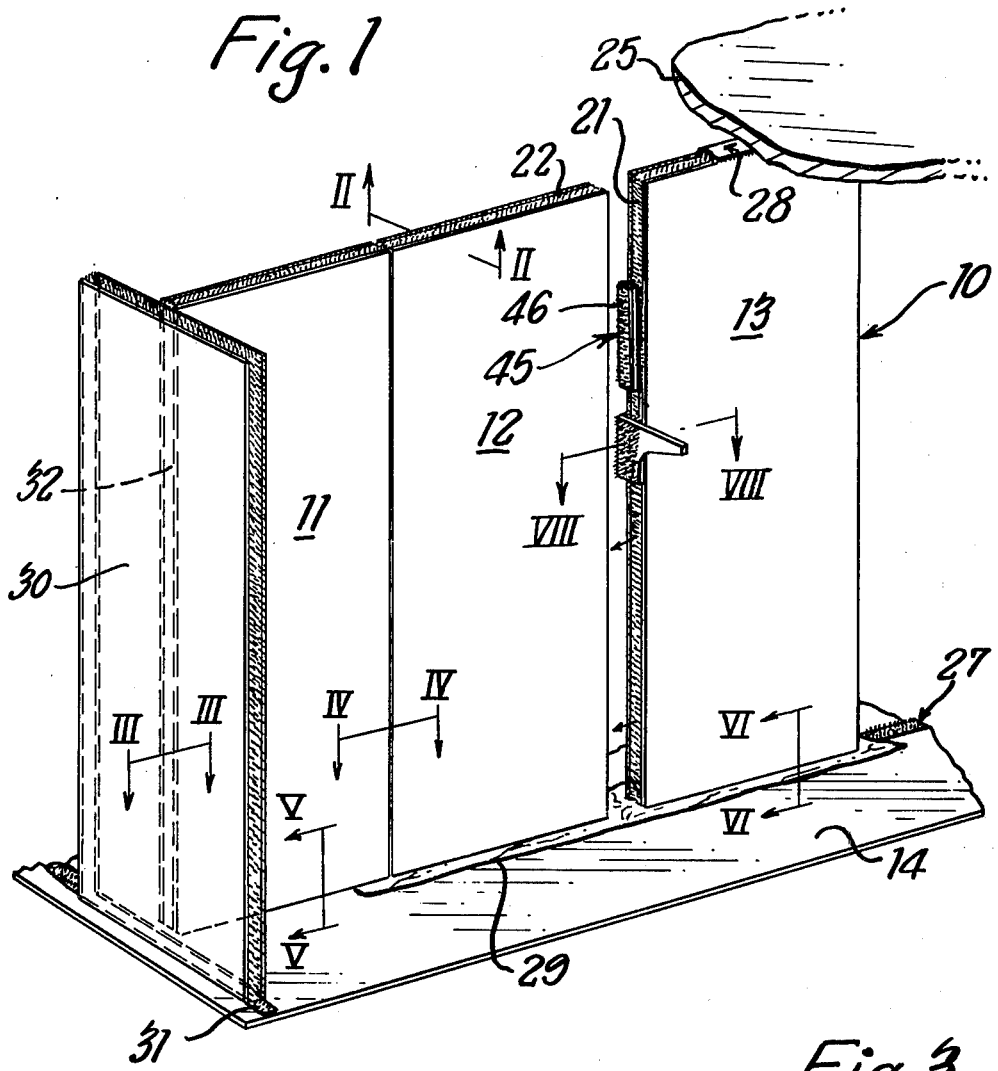
FIG. 1 is a diagrammatic perspective view of a partition wall mounted between a floor surface and ceiling surface and abutting an adjacent supporting wall.
Figure 2:
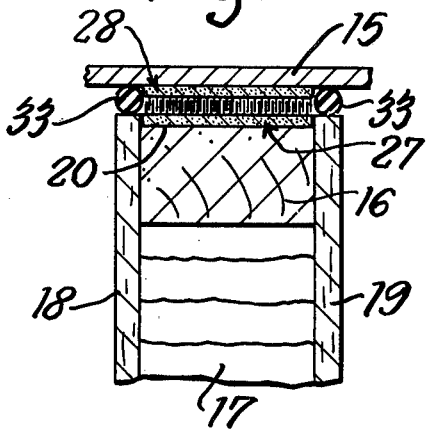
FIG. 2 is a section taken on the line II–II of FIG. 1.
Figure 3:
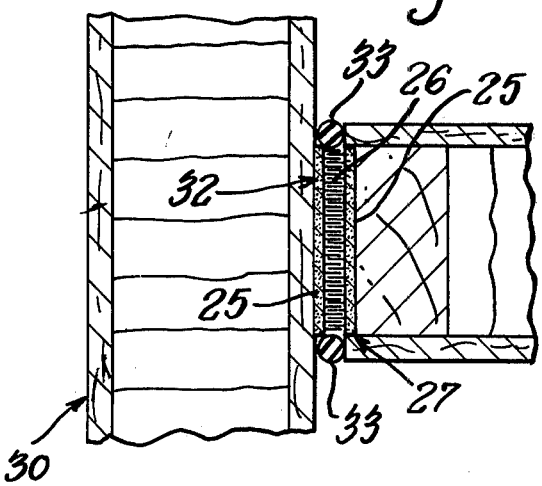
FIG. 3 is a section taken on the line III–III of FIG. 1.

In the drawings, a partition wall is indicated generally at 10, which comprises a plurality of similar wall panels 11, 12 and 13 mounted between a floor surface 14 and a ceiling 15.

Each panel comprises a timber frame 16, a honeycomb fibre-board core 17 and cladding sheets 18 and 19 which can be formed from any suitable material such as a fibre-board. The cladding sheets 18 and 19 project beyond the timber frame 16 on all sides of each of the panels to form a continuous channel 20 around the panel.

Attached to the timber frame 16 within the channel 20 are four strips 21 to 24 of pile material such as that sold under the Registered Trade Name FLOTEX. Each strip 21 to 24 comprises a backing layer 25 of resilient synthetic plastics material in which a plurality of fibres 26 are embedded so as to project outwardly normally from the backing material 25. The depth of the backing layer 25 is approximately 0.10 of an inch and the depth of the channel 20 is similar so that the surface of the backing layer 25 from which the fibres 26 project is flush with the peripheral edges 18*a* and 19*a* of the cladding sheets 18 and 19 and the fibres 26 project wholly from the edge surface of the panel 11. The outer surface of the backing layer 25 can be pre-coated with an impact adhesive if required to enable the strip to be quickly and easily attached to the frame 16 which forms the base of the channel 20.

The fibres 26 are formed from an acrylic material, preferably nylon, and have sufficient rigidity to be self supporting and relatively stiff. The fibres 26, measured from the outer surface of the backing layer 25 to their tips, preferably average 0.08 inches in length and the average density of the fibres is preferably approximately 50,000 fibres per square inch.

A similar strip 27 of pile material is attached to the floor surface 14 to form a band of projecting fibres 26 along the line to be taken by the partition wall 10 and a similar strip 28 is attached to the undersurface of the ceiling 15 to form a band of fibres 26 immediately above the strip 27 on the floor surface.

In order to mount the panels 11, 12 and 13 in position, the panel 11 is aligned over the band of fibres on the floor surface 14 formed by the strip 24. To assist in sliding the panel 11 in to position over the band of fibres 26, a thin plastic sheet 29 is placed over the fibres on the floor surface 14 while the panel 11 is moved into position. The sheet 29 is then withdrawn and the panel 11 drops slightly on to the floor surface 14 so that the fibres 26 on the bottom edge surface of the panel 11 intermesh with the fibres 26 which project upwardly from the floor surface 14.

Either the ceiling 15 or the floor 14 is vertically adjustable, for instance the ceiling may be suspended and readily vertically adjustable within limits of several inches. When the panel 11 is in place, the ceiling is adjusted down so that the projecting fibres 26 on the lower surface of the ceiling 15 just interengage with the fibres 26 which project upwardly from the top edge surface of the panel 11. At this stage, the interengagement between the fibres on the ceiling surface and the fibres on the top edge surface of the panel 11 is sufficient only to prevent the panel 11 from falling under its own weight but is not sufficient to prevent adjustment of the position of the panel 11 relative to the ceiling 15, and insertion of the next panel 12.

The next adjacent panel 12 is now brought up to the panel 11 and is aligned with the band of fibres on the floor surface 14 and on the ceiling 15. The interengagement between the fibres on the top edge surface of the panel 12 and the fibres on the ceiling is not sufficient to prevent insertion of the panel 12 into position between the floor and the ceiling, when the sheet 29 is withdrawn from below the panel 12 the panel drops slightly so that the fibres on the bottom edge surface of the panel 12 intermesh completely with the upwardly projecting fibres on the floor surface 14.

The panel 13 is then located in place in the same manner and any further panels until the partition wall 10 is complete.

As each succeeding panel is slid into position the fibres which project horizontally outwardly from the side edge surfaces of adjacent panels will intermesh so as to lock adjacent panels one to another and resist any shear action between the abutting surfaces of the adjacent panels.

Finally, the ceiling 15 is adjusted downwardly so as to force the fibres on the ceiling 15 into complete intermeshing engagement with the fibres on the top edge surfaces of the panels 11, 12 and 13 so as to clamp the panels between the ceiling and the floor surface 14. This completes the assembly of the partition wall 10 which is securely mounted between the floor and the ceiling with any shear forces acting on the abutting surfaces of the panels and the adjacent floor and ceiling surfaces substantially prevented by the intermeshing engagement of the fibres on the panels and the floor and ceiling surfaces.

If a further partition wall at right-angles to the wall 10 is required, a panel 30, similar to the panels 11, 12 and 13, is mounted between the floor surface 14 and ceiling 15 in a similar manner by attaching strips 31 of pile material to the floor surface and the ceiling surface along the line of the panel or partition wall, attaching a strip 32 of pile material vertically down the internal surface of the panel 30 along the line of abutment between the panel 30 and the adjacent edge surface of the panel 11 and sliding the panel 30 into the position shown in FIG. 1. The panel 30 is slid into position in the same manner as the panels 11, 12 and 13 so that the fibres 26 on the bottom edge surface of the panel 30 intermesh with the fibres on the floor surface 14 and the outwardly projecting fibres on the strip 32 attached to the inside surface of the panel 30 intermesh with the fibres on the abutting vertical edge surface of the panel 11.

In order to ensure a tight intermeshing between the fibres on adjacent abutting surfaces, a small gap will normally be left along each edge of each panel, when the assembly of the partition wall is complete. This gap can conveniently be closed and hidden by a resilient sealing gasket 33 which can be easily pressed into the gap to form a complete seal and finish the appearance of the partition wall.

The strength of the joint provided by the interengaging and intermeshing fibres will depend upon the stiffness of the fibres, the density of the fibres, the material from which the fibres are made and their length. These variable factors can be adjusted to suit the particular conditions in which the partition wall is used. I have found that using a nylon fibre which is substantially rigid, of a length within the range 0.06 to 0.10 of an inch at a density within the range of 30,000 to 70,000 fibres per square inch will ensure a satisfactory joint which provides substantial resistance to shear movement at the interface of the joint. However, these ranges are not necessarily essential, for instance fibres of up to 0.50 of an inch or more may be suitable in some applications and a density of 500 fibres per square inch may also be suitable, particularly if each fibre is relatively thick and rigid.

We have found that a joint of the type described in which the fibres are made from nylon of an average length of 0.08 inches and a density of 50,000 per square inch is substantially draughtproof, sound proof and highly flame proof. When subjected to flame tests it was found that the fibres on the outside surface of the joint melted. However, owing to the density of the fibres and the consequent lack of oxygen combustion occurred only at the outer fibres and did not penetrate the joint to any significant degree. If flame proofing is particularly important in a given application then I envisage that some or all of the fibres may be made from a flame resistant material such as fibreglass, for instance the fibres along the outer edge of each strip may be made of fibre glass and the fibres at the center of each strip maybe made from an acrylic resin, for economy.

The relatively thick foam layer 25 which is provided as a backing for the fibres is preferably sufficiently thick for instance 0.10 of an inch, to take up irregularities in the wall surfaces and also to take up inaccuracies in the size of the partition wall or component panels 11, 12, 13.

It will be appreciated that strips of fibres 26 can be provided along any two or more sides of a partition panel, depending upon the circumstances in which the panel is being used and the stresses to which it will be subjected.

The present invention also lends itself to the provision of brackets or other similar members which can be attached between adjacent panels 12 and 13 so as to project from the partition wall. A typical bracket suitable for locating and mounting between adjacent panels is indicated generally at 40 in FIGS. 7 and 8.

The brackets 40 comprises an arm 41, which is adapted to project from the partition wall 10, and a plate 42 the sides of which are covered with strips of pile material 43 and 44 respectively. The pile material forming the strips 43 and 44 respectively. The pile material forming the strips 43 and 44 is similar to that employed in the strips 21 to 24. When the plate 42 is inserted between adjacent partition panels 11 and 12, the fibres on the strips 43 and 44 will interengage and mesh with the fibres on the strips 21 and 23 on adjacent vertical edge surfaces of the butted panels so as to retain and hold the bracket 40 in position.

In order to fill the gap between the panels 12 and 13 above and below the bracket 40, spacers 45 are provided. Each spacer comprises a rigid plate with strips 46 of pile material on each side. The spacers are inserted between the panels 12 and 13 above and below the bracket 40 and the fibres at the strip 46 intermesh with the fibres on the strips 21 and 23 on the adjacent vertical edge surfaces of the panels 12 and 13.

It will be appreciated that other articles and components can be mounted in the same way as the bracket 48 so as to project from between adjacent panels of the partition wall 10.

It will also be appreciated that the jointing method of the present invention can be empolyed to join any two members together where the adjacent surfaces of the two members are butted together and the joint has to withstand only shear forces at the interface between the two members.

The jointing method of the present invention is particularly suitable for use in the housing systems and structures described in my co-pending U.S. patent application Ser. No. 590,101 which describes a housing unit in which the floor is suspended from the ceiling and the distance from the floor to the ceiling is adjustable so as to clamp the partition wall panels between the floor and the ceiling. This enables the partition panels of the present invention to be placed in position and the floor and ceiling to be subsequently drawn together to clamp the panels in place, ensuring a complete intermeshing of the fibres on the panel edges with the fibres on the floor and ceiling.

However, the method of the present invention can be employed in any situation in which it is possible to provide relative adjustment between the floor and ceiling so as to clamp the partition panels between the floor and ceiling after they have been located in position.

I claim:

1. A method of erecting a partition wall in a building, comprising the steps of providing a plurality of substantially rigid, substantially straight self-supporting fibres on the top and bottom horizontal edge surfaces of the panel so that the fibres project from the edge surface substantially normally thereto;

providing a plurality of substantially rigid, substantially straight self-supporting fibres in a lower band along the floor surface of the building and in an upper band along the ceiling surface of the building so that said fibres on the floor and ceiling surfaces project substantially normally thereto;

aligning the panel between the upper and lower bands of fibres;

moving the floor and ceiling surfaces relative to one another so as to clamp the panel between the floor and ceiling surfaces and cause the fibres on the top edge surface of the panel to intermesh with the fibres on the ceiling surface and the fibres on the bottom edge surface of the panel to intermesh with the fibres on the floor surface, whereby shear movement between the top and bottom edge surfaces of the panel and the ceiling and floor surfaces, respectively, are substantially prevented.

2. A method as claimed in claim 1, in which the density of the fibres is within the range 30,000 to 70,000 fibres per square inch and the length of the fibres is within the range 0.06 to 0.10 of an inch.

3. A method as claimed in claim 2, including the further step of interposing a backing strip of resilient material between the fibres and each edge surface of the panel and between the fibres and the floor and ceiling surfaces.

4. A method as claimed in claim 3, including the further steps of providing a plurality of substantially rigid, substantially straight self-supporting fibres on the vertical side edge surfaces of the panel so that said side fibres project substantially normally from said side edge surfaces;

providing a plurality of substantially rigid, substantially straight self-supporting fibres in vertical bands along vertical said supporting surfaces adjacent the panel so that said fibres project substantially normally from said vertical side supporting surfaces;

aligning the panel between the vertical bands of fibres; and moving the side supporting surfaces relatively towards one another to clamp the panel therebetween and cause the fibers on the vertical side edge surfaces of the panel to intermesh with the fibres on the vertical side supporting surfaces, whereby shear movement between the vertical side edges surfaces of the panel and the vertical side supporting surfaces is substantially prevented.

* * * * *